227-53 SR
10/22/85 OR 4,548,345

United States Patent [19]
Puritz et al.

[11] Patent Number: 4,548,345
[45] Date of Patent: Oct. 22, 1985

[54] AUTOMATIC RIVETING MACHINE

[75] Inventors: Wolfgang Puritz, Buxtehude; Wilhelm Lengen, Rosengarten/Sieversen, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 523,339

[22] Filed: Aug. 15, 1983

[30] Foreign Application Priority Data

Aug. 28, 1982 [DE] Fed. Rep. of Germany ..... 3232093

[51] Int. Cl.[4] ..... B21J 15/12; B21J 15/14; B21J 15/18

[52] U.S. Cl. ..... 227/58; 227/69; 227/112; 227/152; 227/111

[58] Field of Search ..... 227/5, 51, 61, 62, 69, 227/112, 155, 142, 143, 144, 152, 111

[56] References Cited

U.S. PATENT DOCUMENTS 3,685,716 8/1972 Frankie et al. ..... 227/51 X
3,747,193 7/1973 Gregory ..... 227/51 X
4,220,275 9/1980 Hametner et al. ..... 227/5

*Primary Examiner*—Paul A. Bell
*Attorney, Agent, or Firm*—W. G. Fasse; D. H. Kane, Jr.

[57] ABSTRACT

This automatic riveting machine can access confined component parts, has a simple sensor system to locate component part edges which allows it to be used in special equipment or in robots. The riveting machine has a mounting bracket to which a rivet supply unit, a riveting unit, and a drill feed advance unit are movably attached. A pneumatic cylinder drives each unit from its resting position into the operating position while shock absorbers brake these movements. Another pneumatic cylinder locks all units into the resting position when the compressed air supply in interrupted. The rivet supply unit pneumatically shoots single rivets into pre-drilled holes in the component parts. The riveting unit is constructed as a so-called alligator riveting press which clamps the component parts together and presses or rivets the heads of the rivets. The drill feed advance unit drills holes into multiple component parts while locating their edges, pressing them together, and compensating for any positional tolerances. All power necessary for operation is supplied by pneumatic cylinders and plate springs in this lightweight automatic riveting machine.

10 Claims, 8 Drawing Figures

AUTOMATIC RIVETING MACHINE

BACKGROUND OF THE INVENTION

This invention relates to an automatic riveting machine which is especially suitable for clip-riveting ribs and spars as required in the manufacture of aircraft.

Various embodiments of such machines are known in the art. All prior art riveting machines have a variety of deficiencies. For example, it is not possible with the prior art machines to gain easy access to component parts in confined locations. Also, cumbersome towing or carrying systems are necessitated by machines that weigh too much and require a fluid operating medium that requires a substantial expenditure for supply conduits.

OBJECTS OF THE INVENTION

In view of the above it is the aim of the invention to achieve the following objects singly or in combination:

to produce a riveting machine as described above that has versatile applications, especially for riveting component parts in confined locations;

to construct a riveting machine of this type so that it may be easily converted or reset according to any prevailing circumstances, or individual requirement; and to assure a rapid, yet certain position of the machine at the riveting location.

SUMMARY OF THE INVENTION

According to the invention an automatic riveting machine for clip-riveting ribs and spars or the like, or any other components that are not easily accessible is characterized by an integrated functional assembly comprising a drill feed advance unit with a built-in sensor, a rivet supply unit, and a riveting unit, that can all be mounted attachably and interchangeably to a holding bracket that is equipped with guides. The bracket connects the individual units to energy sources by means of pneumatic clutches and electrical plug-in connections. The machine is equipped with a clamping cone for the attachment to robots and similar devices or equipment.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
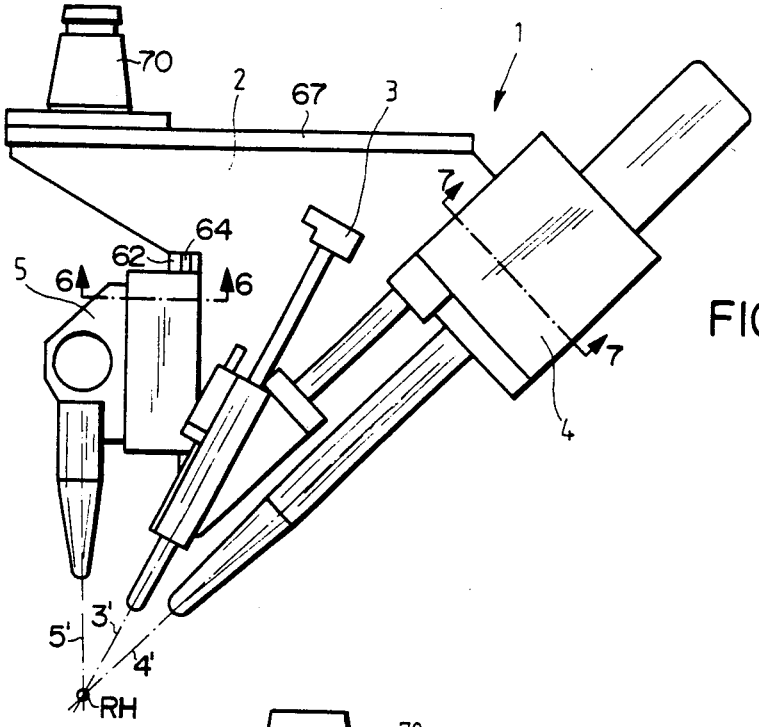
FIG. 1 is a top plan view of the assembled machine.

FIG. 1 shows a complete overview of an automatic riveting machine 1 that comprises a holding or mounting bracket 2, a rivet supply unit 3, a riveting unit 4, and a drill feed advance unit 5.

Figure 2:
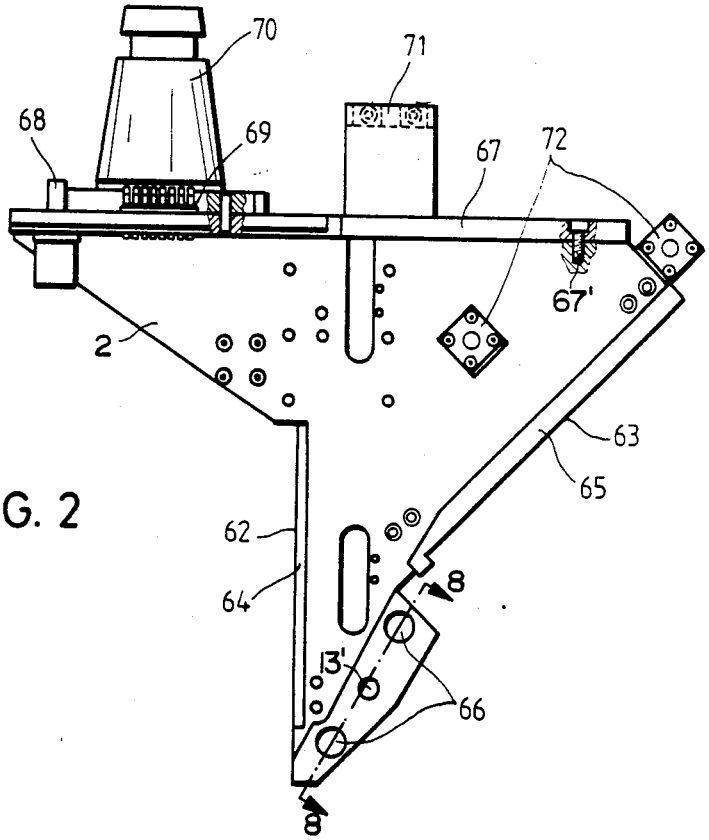
FIG. 2 is a top plan view of the holding or mounting bracket.

The holding or mounting bracket 2 shown in FIG. 2 serves as a mounting for all of the individual units including units 3, 4, 5 that are required for a riveting operation. Some of these units are rigidly attached to the mounting bracket 2 while others such as units 3, 4, 5 are movably or exchangeably attached to this mounting bracket 2. Guide rail means 64 of conventional construction are screwed onto the edge surface 62 of the mounting bracket 2 for movably or displaceably attaching the drill feed advance unit 5 to the bracket 2. Further guide rail means 65 of conventional construction are secured to the edge surface 63 of the mounting bracket 2 for movably or displaceably attaching the riveting unit 4 to the bracket 2. The riveting unit 4 is also referred to as riveting press 4. Furthermore, conventional guide bushings 66 are inserted in the mounting bracket 2 for movably securing of the rivet supply unit 3 to the bracket 2. The front surface of the bracket 2 is equipped with a mounting plate 67 also shown in FIG. 1 to which a pneumatic clutch 68, electrical plug-in connections 69, a clamping cone 70, a supporting block 71 for electrical cables and pneumatic hoses, and a pneumatic locking cylinder 72 are connected. As shown in FIG. 2, the plate 67 is screwed to the bracket 2 by screws 67'.

Figure 3:
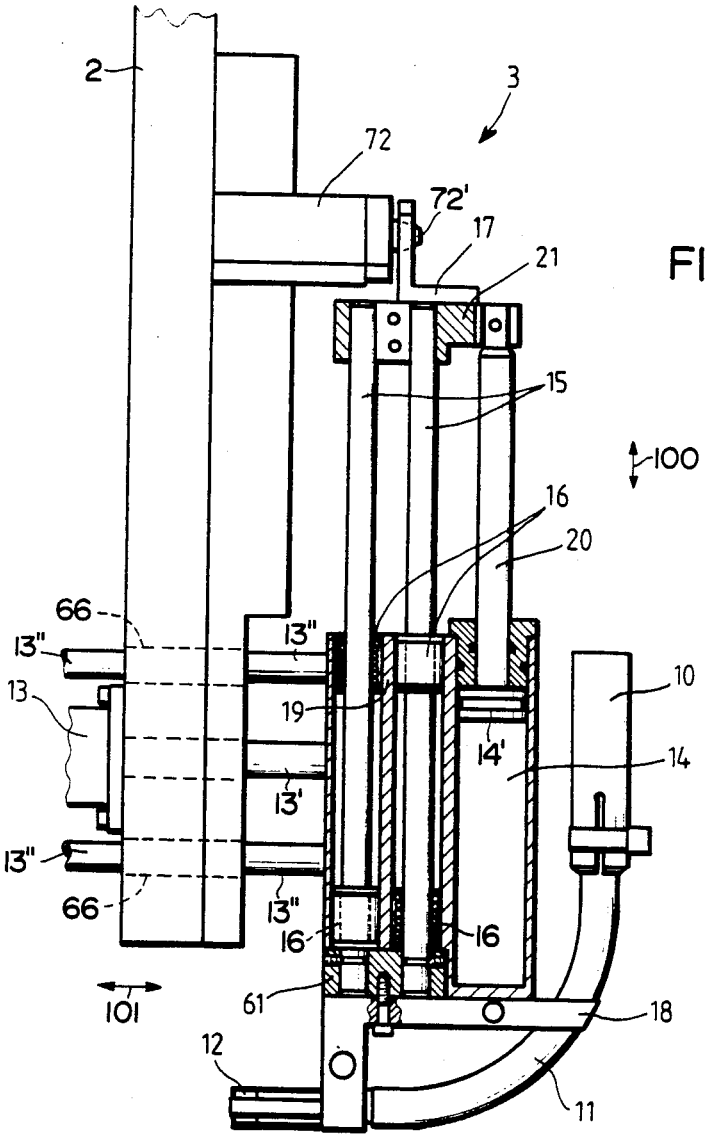
FIG. 3 is a partial sectional view of the rivet supply unit.

FIG. 3 shows the rivet supply unit 3 which is inserted into the guide bushings 66 and is arranged for cooperation one of the pneumatic locking cylinders 72. The rivet supply unit 3 comprises the following main components: a base 19, two guide systems, a rivet supply system or pipe 10, 11, a rivet centering pipe 12, and an adjusting holding angle bracket 18 mounting the rivet supply system 10, 11 to the base 19. The first guide system comprises first guide shafts 15 and a ball box 16. The guide shafts 15 are fixed in the end plate 21 and in the plate 61 and are driven, together with the holding angle bracket 18 and the rivet supply and centering pipes 10, 11, 12, by means of a pneumatic drive cylinder 14 from a resting position into a position shown in FIG. 3 in which the axis of the pre-drilled rivet hole RH is lined up with the axis of the centering pipe 12. Thus, the first guide rods 15 together with the drive cylinder 14 provide for a first guided movement of the rivet supply unit 3 up and down as shown by the arrow 100 in FIG. 3, which is in the plane of the drawing of FIG. 1. The alignment condition of the rivet hole RH with the pipe 12 is produced by adjusting the holding angle bracket 18 and the limit stop 21 prior to starting an operation. In FIG. 1 the axis of the predrilled rivet hole RH extends perpendicularly to the plane of the drawing sheet. FIG. 1 also shows that the longitudinal axes 3', 4', and 5' of the units 3, 4, and 5 respectively substantially converge toward the rivet hole RH.

From its preliminary positioning, the rivet supply unit 3 is driven, guided by the second guidance system 13, 131, 13, in the direction 101 of the axis of a component to be riveted in the hole RH, that is perpendicularly to the sheet of FIG. 1, by means of the pneumatic cylinder 13 mounted on the bracket 2 and connected with its piston rod 13' to the base 19. The base 19 is also rigidly secured to two guide rods 13" slidably guided in said guide bushings 66 until the centering pipe 12 rests against the component part. In this position, a rivet passes from a conventional rivet separator through a plastic hose and is shot into the predrilled hole RH by the supply and centering pipes 10, 11, 12, thereby using compressed air. After the riveting operation has been completed the rivet supply unit 3 automatically rides back to its resting position shown in FIG. 3. In this resting position the cylinder 72 with its piston rod end 72' automatically locks the rivet supply unit 3 in the resting position by entering into a hole in a locking bracket 17 when the compressed air supply is interrupted or shut off. The bracket 17 is secured to the end plate 21 and rides up or down with the elements 21, 15, 20, 61, 10, 11, 12, 18 when air under pressure is introduced into the cylinder 14 below or above the piston 14' connected to the rod 21. During movement in the direction 100 the rod end 72' does not engage the hole in the bracket 17.

Figure 4:
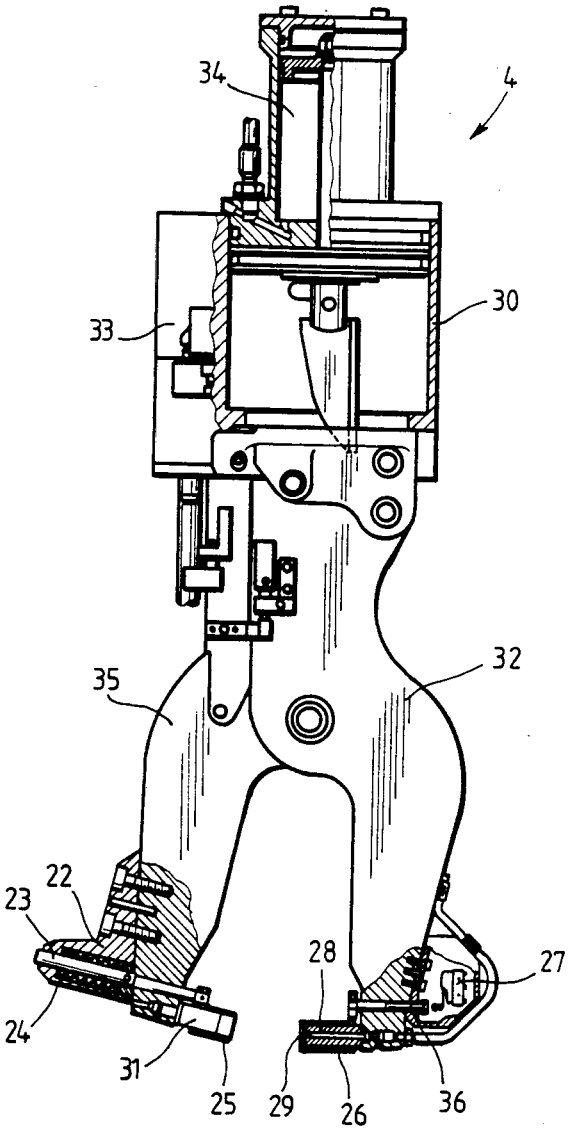
FIG. 4 is a partial sectional view of the riveting unit.

The riveting unit 4 shown in FIG. 4 is constructed as a so-called alligator riveting press, which has two jaws 32 and 35, one of which is a stationary jaw 32 with a riveting insert 28 connected to its front or free end and the other is a movable jaw 35. A bushing 26 with a spring-loaded tripping pin 36 is guided along the outer diameter of the riveting insert 28. This tripping pin 36 actuates a switch 27 and closes a contact or rather control circuit that stops the motion of the entire unit and thus of the jaw 32 in the direction toward the component part to be riveted. A pitot tube 29 is located in the middle of the riveting insert. This pitot tube 29 only develops pressure and breaks the contact when a rivet is in a borehole.

The movable jaw 35 is activated by the contact or switch 27. A so-called flat riveting set 31 is located at the front end of the movable jaw 35 and has a pressure bushing 25 guided along its outer diameter. This pressure bushing 25 causes the component parts that are to be riveted, for example plates or sheets, to be pressed or clamped together before the rivet is pressed or riveted. The power to accomplish this clamping is transferred from a set of plate or Belleville springs 24 through a pin 23 to the pressure bushing 25. A housing 22, that is rigidly attached to the movable jaw 35 forms an abutment. The power for pressing or riveting the rivet head is generated by means of the pneumatic tandem cylinders 34, 30 attached above the rivet tongs or jaws. Roller elements are secured to the outside of the tandem cylinder housing to enable the radial movement of the riveting unit on the guide rail 65 (FIG. 2).

The movement of the riveting unit 4 from the resting position to the operating position and back along its guide rail 65 is caused by a pneumatic cylinder 33. These movements are braked by means of built-in shock absorbers before the limit stops are reached. This unit is also locked in the resting position by the cylinder 72 and the locking bracket 17 whenever the compressed air supply is interrupted or shut off.

Figure 5:
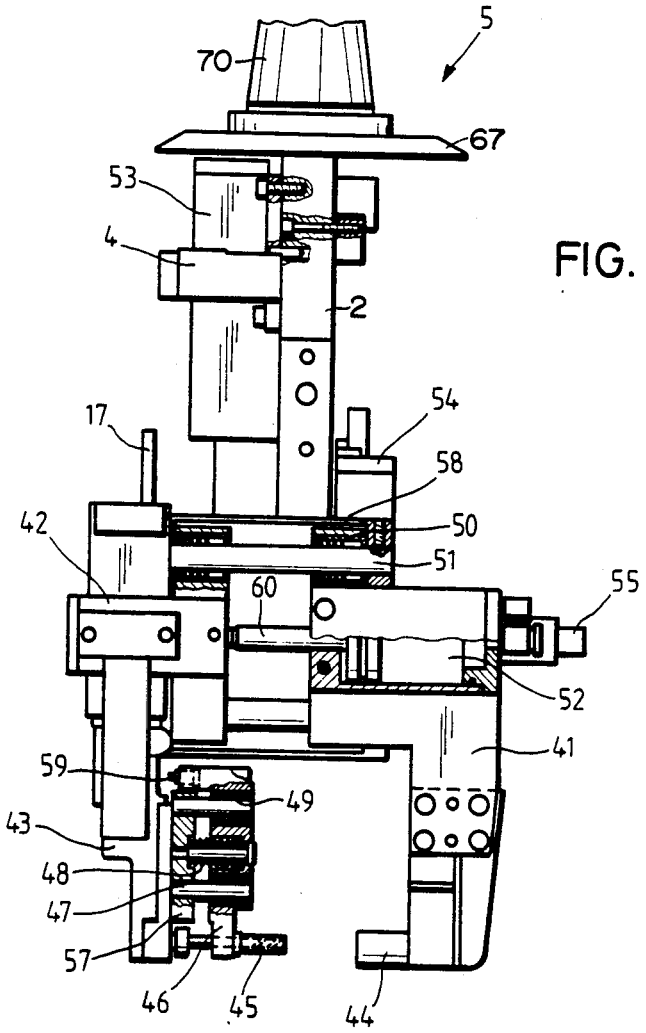
FIG. 5 is a partial sectional view of the drill feed advance unit.
Figure 7:
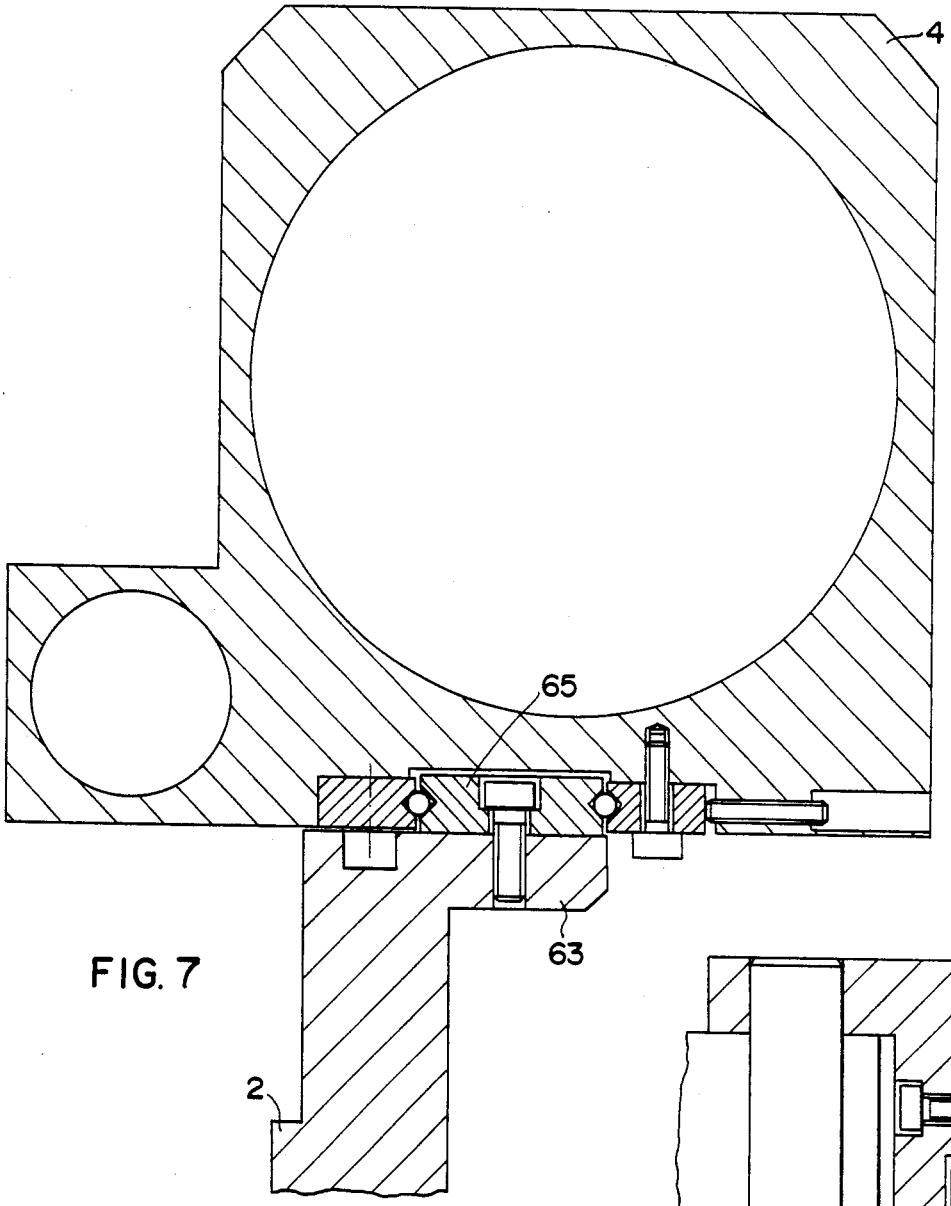
FIG. 7 is a sectional view along section line 7—7 in FIG. 1.
Figure 6:
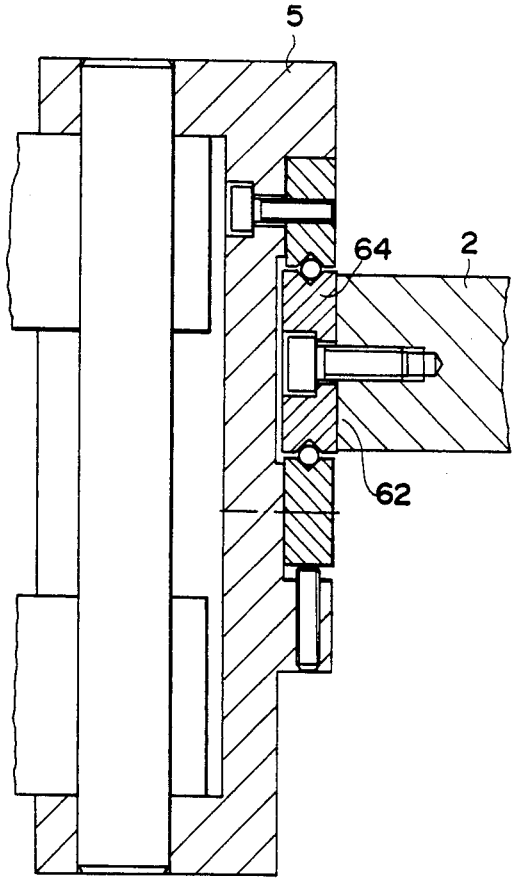
FIG. 6 is a sectional view along section line 6—6 in FIG. 1.
Figure 8:
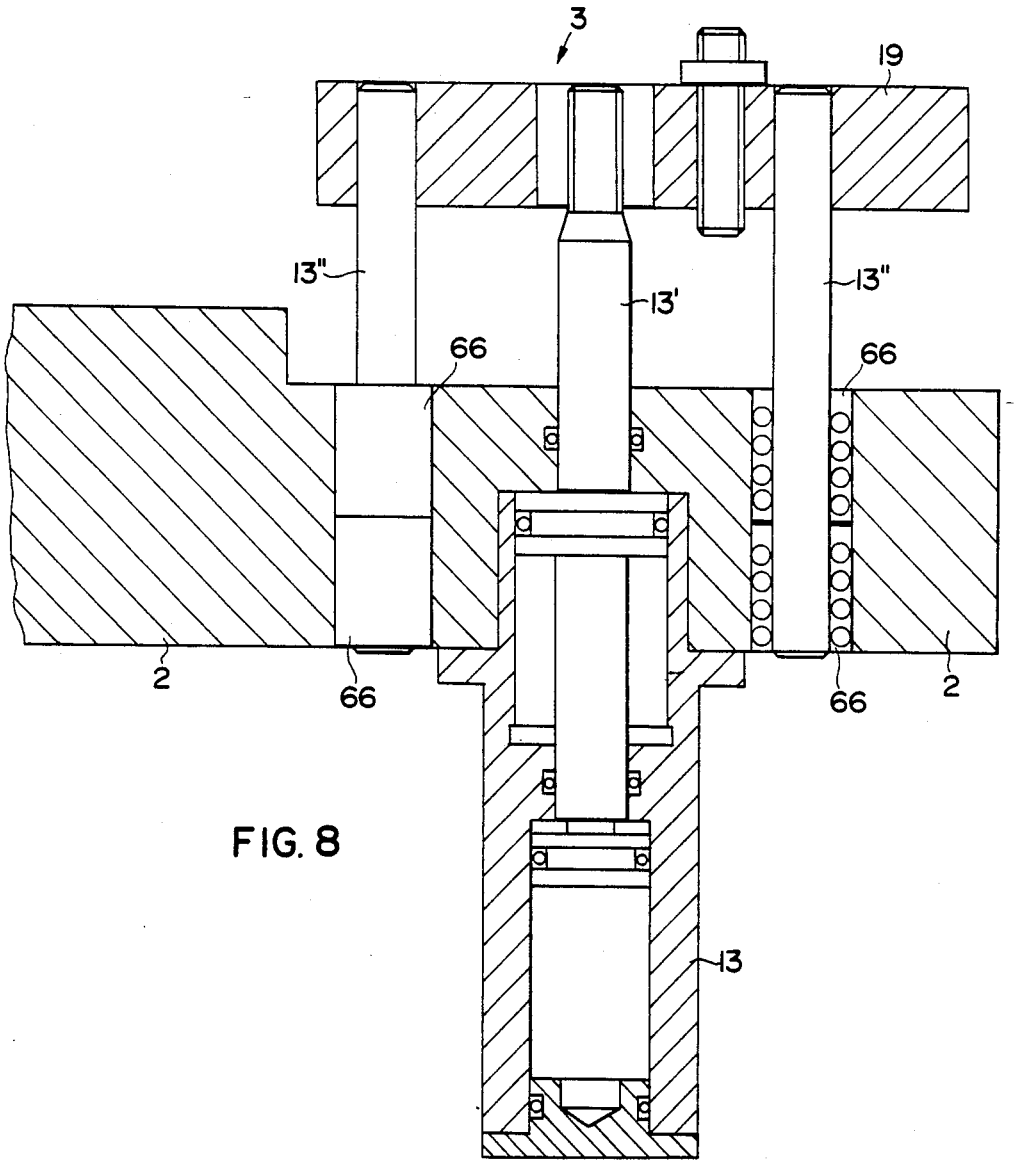
FIG. 8 is a sectional view along section line 8—8 in FIG. 2.

The drill feed advance unit 5 is shown in FIG. 5 and comprises two guide members 41 and 42 secured in a box-shaped base 58 and parallely guided by means of ball boxes 50 and guide shafts 51. An angular-type drill press 43 is connected by a spring-loaded drill bushing guidance system to the guide member 42. This angular-type drill 43 comprises a base plate 57, guide shafts 47, ball boxes 49, sets of plate or Belleville springs 48, a guide plate 46, a drill bushing 45, and a so-called drilling depth adjustment member 59. This construction allows the drill bushing 45 to rest against the component part to be riveted without tilting, thereby pressing several components tightly against each other and against a counterholder 44 with the power of the plate or Belleville springs 48. The drilling depth is adjusted by means of the drilling depth adjustment member 59.

A pneumatic cylinder 52 with piston 60 is arranged in the upper region of the guide member 41, while the counterholder 44 with a pneumatic-electronic sensor is mounted in the lower region.

The guide members 41 and 42 are connected to each other by the piston rod 60 and are moved against each other by the cylinder 52. This movement results in the feed advance for drilling the rivet hole. The feed advance speed can be regulated by adjustable hydro-dampers. The guide system 50, 51 allows the guide members 41, 42 to be pulled together without producing any lateral forces and to align themselves with the component part. Additionally, positional tolerances of the component parts are compensated.

The drill feed advance unit 5 with the roller elements in the ball box 50 on the base 58 is driven from the resting position to the operating position by a pneumatic cylinder 53 along the guide rail 64 on the mounting bracket 2 (FIG. 2). The movements of the cylinder are braked by shock absorbers before the limit stops are reached. After the drilling operation, the drill feed advance unit 5 is automatically driven to the resting position thereby freeing the work area at the rivet hole RH for the following unit. This unit is also automatically locked by a respective cylinder 72 and a respective locking bracket 17 whenever the compressed air supply is interrupted or shut off.

An automatic riveting machine 1 may now be produced according to the above features which is characterized by its ability to easily access component parts in confined locations and by its low weight. The edges of component parts are found quickly and reliably with the simple sensor system which also allows the machine to be used in special equipment or in robots.

Although the invention has been described with reference to specific example embodiments, it will be appreciated that it is intended to cover all modifications and equivalents within the scope of the appended claims.

What is claimed is:

1. A riveting apparatus for riveting components which are difficult to reach, comprising mounting bracket means (2), component guide means (15, 66; 65; 64) operatively supported by said mounting bracket means (2), operating components (3, 4, 5) comprising drilling feed advance means (5) movably mounted on a respective guide (64) of said component guide means, sensor means forming part of said drilling feed advance means (5) for sensing a part to be riveted, rivet supply means (3) operatively mounted on a respective guide (66) of said component guide means, and riveting means (4) operatively mounted on a respective guide (65) of said component guide means, said apparatus further comprising attachment means (70) carried by said mounting bracket means (2) for securing said mounting bracket means (2) with all operating components (3, 4, 5) carried by the mounting bracket means to another apparatus, and plug-in type control and power supply connector means (68, 69) carried by said mounting bracket means (2) for providing the required control and power supply to said operating components (3, 4, 5), and wherein each of said operating components (3, 4, 5) has a longitudinal axis (3', 4', 5'), said component guide means (15, 65, 64) being so located on said mounting bracket means (2) that said longitudinal axes (3', 4', 5') substantially converge toward a rivet hole (RH).

2. The apparatus of claim 1, wherein said plug-in type connector means comprise electrical and pneumatic connector means.

3. The apparatus of claim 1, wherein said component guide means on said mounting bracket means (2) comprise two rails (64, 65) releasably connected to said mounting bracket means (2) for movably mounting two of said operating components, and a guide bushing (66) for movably mounting one of said operating components.

4. The apparatus of claim 1, wherein said rivet supply means (3) comprises a base (19), a rivet supply pipe (11), a centering pipe (12), and a pneumatic cylinder (13) assembled mounted on said mounting bracket (2) for moving said rivet supply means in a direction (101) toward a part to be riveted.

5. The apparatus of claim 1, wherein said riveting means (4) comprise pneumatically actuated riveting tongs with a stationary jaw (32) and with a movable jaw (35).

6. The apparatus of claim 5, further comprising a riveting insert (28) arranged on said stationary jaw (32) of said riveting means.

7. The apparatus of claim 1, wherein said riveting means (4) comprise first pneumatic tandem cylinder means (30, 34) for pressing or riveting a rivet head, and second pneumatic cylinder means (33) for moving the riveting means (4) into or out of a working position.

8. The apparatus of claim 1, wherein said drilling feed advance means (5) comprise a first guide member (41) including a pneumatic cylinder (52) and counterholder means (44) including a built-in pneumatic-electronic sensor, and a second guide member (42) including an angular-type drill (43) having a spring-loaded drill bushing guidance system (50, 51).

9. The apparatus of claim 1, wherein said drill feed advance means (5) comprises a base, pneumatic drive means (53) for driving into a working position, and roller elements supporting said feed advance means (5) on said base (58) for movement by said pneumatic drive means (53).

10. The apparatus of claim 1, further comprising locking bracket means (17), a cylinder (72) having a piston rod (72') operatively arranged to automatically engage a hole in said bracket means (17) for locking said drilling feed advance means (5) and said riveting means (4) in a rest position whenever a compressed air supply is shut off.

* * * * *